United States Patent [19]

Berecz

[11] Patent Number: 4,574,609

[45] Date of Patent: Mar. 11, 1986

[54] NUT FORMING APPARATUS

[75] Inventor: Imre Berecz, El Toro, Calif.

[73] Assignee: Microdot Inc., Darien, Conn.

[21] Appl. No.: 591,801

[22] Filed: Mar. 21, 1984

[51] Int. Cl.[4] ..... B21J 7/16; B21J 13/08; B21K 1/68

[52] U.S. Cl. ..... 72/354; 10/76 T; 10/77; 72/356; 72/359

[58] Field of Search ..... 72/354, 356, 359; 10/13, 77, 76 T

[56] References Cited

U.S. PATENT DOCUMENTS

| | | | |
|---|---|---|---|
| 460,553 | 10/1891 | Burdick | 10/77 |
| 3,154,977 | 11/1964 | Schultz | 72/354 X |
| 4,019,432 | 4/1977 | Dunkin | 10/13 |
| 4,175,417 | 11/1979 | Vergnani et al. | 10/77 X |
| 4,272,978 | 6/1981 | Berecz | 10/13 X |

FOREIGN PATENT DOCUMENTS

| | | | |
|---|---|---|---|
| 0716696 | 2/1980 | U.S.S.R. | 72/356 |

*Primary Examiner*—Francis S. Husar

*Assistant Examiner*—Steven B. Katz

*Attorney, Agent, or Firm*—Lyman R. Lyon

[57] ABSTRACT

A nut forming apparatus in which a pair of identical die assemblies are housed in a pair of diametrically opposed boxes in a rotary block and rearward movement of the die assembly relative to the rotary block at a first die station is precluded but rearward movement of that die assembly is allowed as it is moved to a second die station by rotary movement of the rotary block. A fixed back pierce pin, associated with each die assembly, is thus inoperative in response to a front forming blow struck by a punch positioned at the first die station but operates to back pierce the nut blank upon rearward movement of the die assembly in response to a front forming blow struck by a punch positioned at the second die station. A pair of cammingly interfaced cylindrical members associated with each die undergo relative rotation as the die assembly is moved by rotation of the rotary block between the first and second die stations to respectively preclude and allow rearward movement at that die assembly.

3 Claims, 7 Drawing Figures

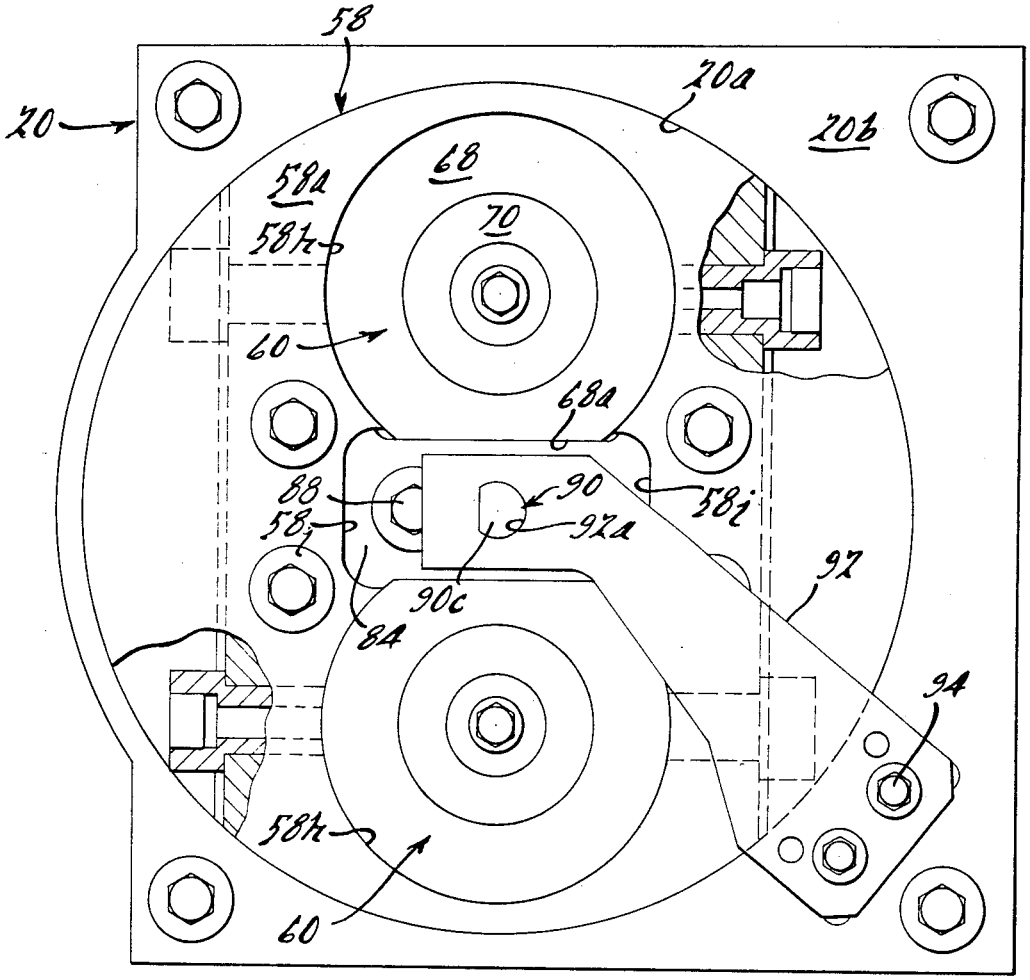
FIG. 2.
FIG. 3.
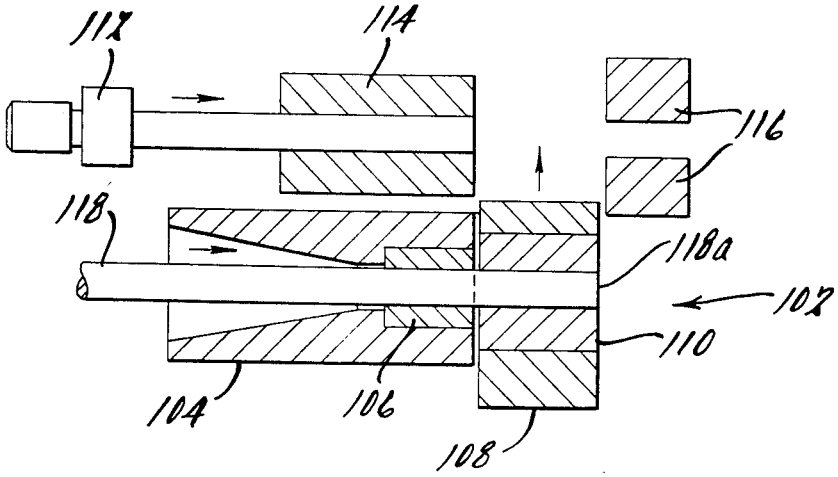

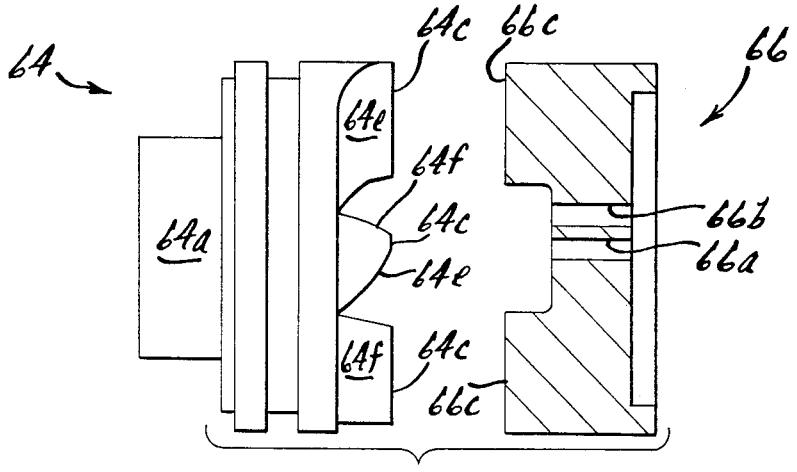
FIG. 4.
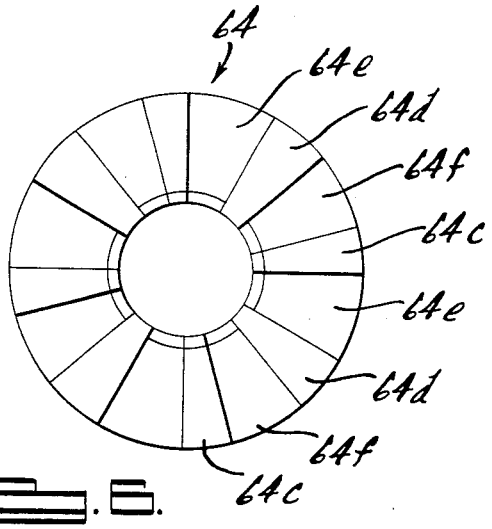
FIG. 6.
FIG. 7.
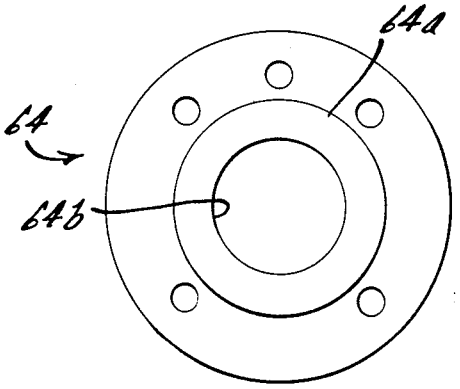
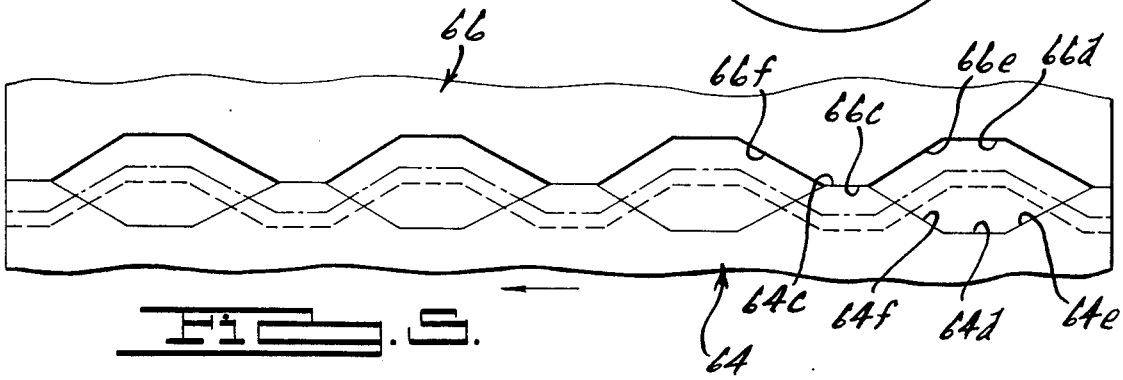
FIG. 5.

NUT FORMING APPARATUS

BACKGROUND OF THE INVENTION

This invention relates to a multi-blow cold forging apparatus and, more particularly, to cold forging apparatus for forming nuts.

In a typical prior art cold forging apparatus for forming nuts, the nut blank is progressively formed by a plurality of punches respectively coacting with a plurality of individual dies. The nut blank, following each forming blow at each die station, is transferred to the next station for a further blow. Typically, at the final die station, the die is mounted for rearward movement and the nut blank is simultaneously front formed by the punch and back pierced by a fixed piercing pin positioned concentrically behind the die. Whereas this apparatus, and its variants, produce a generally satisfactory finished nut, the overall speed of the apparatus is limited by the necessity of ejecting the partially formed nut blank from the die after each punching operation and then transferring the ejected blank to the next die station.

SUMMARY OF THE INVENTION

The object of the present invention is to increase the operational speed of conventional nut forming apparatus without diminishing the quality of the nuts produced.

According to the invention, a die is mounted for movement between a first die station and a second die station and means are provided to preclude rearward movement of the die while positioned at the first die station while allowing rearward movement of the die in response to movement of the die to the second die station. With this arrangement, a punch positioned at the first die station may deliver a forming blow to the front of a nut blank positioned in the die at that station whereafter the die, with the formed nut blank therein, may be moved to the second die station where the rearward move of the die will allow back piercing of the nut by a suitable fixed piercing pin.

According to a further feature of the invention, the nut forming apparatus includes two identical dies which are moved alternately and successively between the first and second die stations, and each die is precluded from rearward movement while positioned at the first die station but is allowed to move rearwardly while positioned at the second die station.

According to another feature of the invention, the dies are respectively mounted in diametrically opposed bores in a rotary block so that the dies may be moved successively and alternately between the first and second die stations by selective rotation of the rotary block.

According to another feature of the invention, each individual die forms a part of an identical die assembly, each die assembly includes two cylindrical members fitted front to back in a respective bore in the rotary block and having coacting cam means at their interface, and the cylindrical members undergo selective relative rotation as the rotary block is rotated between an axially abutting configuration, in which rearward movement of the related die is precluded, and an axially spaced configuration, in which rearward movement of the related die is allowed.

In the disclosed embodiment of the invention, the forward cylindrical member of each die assembly is precluded from rotation in the respective bore in the rotary block, and a planet gear is coaxially secured to each rearward cylindrical member and meshes with a fixed central gear so that the rearward members are rotated in response to rotary movement of the rotary block to selectively move the cylindrical members of each die assembly between their axially abutting configuration and their axially spaced configuration.

BRIEF DESCRIPTION OF THE DRAWINGS

FIG. 2 is a view taken on line 2—2 of FIG. 1 with the punches omitted for purposes of clarity;

FIG. 3 is a fragmentary somewhat schematic view of a cutter assembly for use with the nut forming apparatus of FIG. 1;

FIG. 4 is an exploded view of a set of cammingly coacting cylindrical members employed in the invention nut forming apparatus;

FIG. 5 is a development of the coacting cam faces on the cylindrical members of FIG. 4; and FIGS. 6 and 7 are front and rear views respectively of the left hand cylindrical member of FIG. 4.

DETAILED DESCRIPTION OF THE PREFERRED EMBODIMENT

Figure 1:
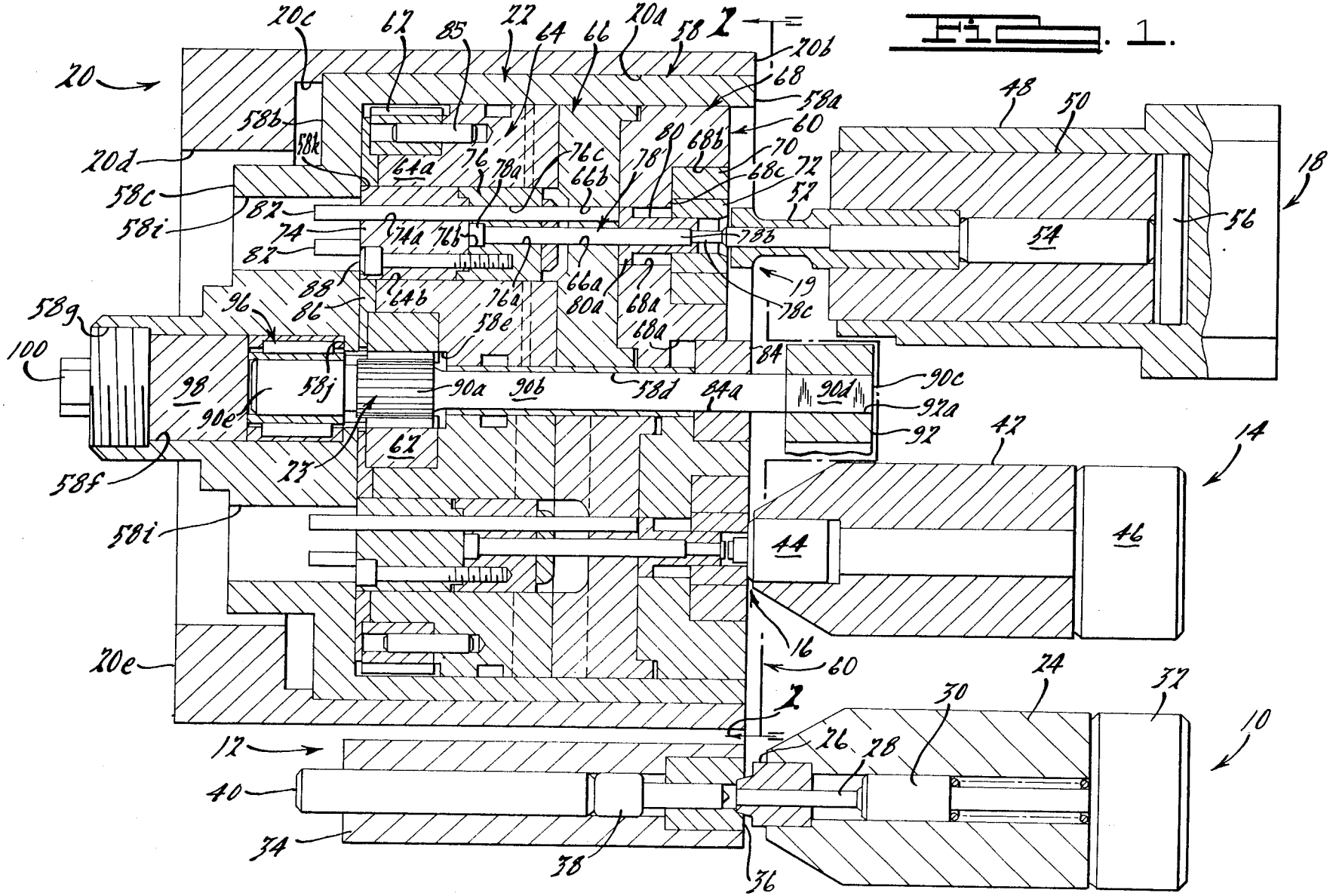
FIG. 1 is a longitudinal cross-sectional view of a nut forming apparatus according to the invention.

The nut forming apparatus seen in FIG. 1 includes a punch assembly 10 positioned for coaction with a fixed die assembly 12; another punch assembly 14 positioned for coaction with a die positioned at a die station 16; another punch assembly 18 positioned for coaction with a die positioned at a die station 19; a housing 20; a rotary assembly 22 mounted for selective rotary movement in housing 20; and a fixed gear assembly 23.

Punch assembly 10 delivers the first blow in the nut forming operation and includes a hammer casing 24, an upset punch 26 seated in the tip of hammer casing 24, an upset pin 28, an anvil upset pin 30, and a backup plug 32.

Fixed die assembly 12 includes a die case 34, a die 36 seated concentrically in the forward end of die case 34, an anvil 38, and an ejector pin 40.

Punch assembly 14 delivers the second blow in the nut forming operation and includes a punch holder 42, an intermediate punch 44 seated in the tip of holder 42, and a backup plug 46.

Punch assembly 18 delivers the final piercing blow in the nut forming operation and includes a punch casing 48, a punch holder 50 seated in casing 48, a pierce punch 52 seated in holder 50, a slug guide pin 54, and a backup plug 56.

Housing 20 defines a large central bore **20*a* opening in the forward face 20*b* of the housing, a counterbore 20*c*, and a further counterbore 20*d* opening in the rear face 20*e*** of the housing.

Rotary assembly 22 includes a rotary block 58 and a pair of identical die assemblies 60 carried by rotary block 58. Rotary block 58 is cylindrical and is rotatably mounted in housing central bore **20*a* with its front face 58*a* flush with housing front faces 20*d*, its rear face 58*b* seated on the shoulder formed between housing bore 20*a* and housing counterbore 20*c*, and a rearwardly extending hub portion 58*c* positioned in housing counterbore 20*d*. Rotary block 58 defines a central longitudinal bore 58*d* opening adjacent the front face of the block, a central counterbore 58*e*, a further central counterbore 58*f*, and a still further central threaded counterbore 58***g* opening at the rear end of the block. Rotary block 58 further defines a pair of identical diametrically opposed bores 58*h* opening in the front face of the block. The rear end of each bore 58*h* breaks through central counterbore 58*e* to provide communication between bores 58*h* and the central bore of the block. An access opening 58*i* is provided in the rear end of the block in coaxial alignment with each bore 58*h*.

Each die assembly 60 includes a planet gear 62, a ramp block 64, an anvil 66, a die case 68, a shrink ring 70, a die 72, a backup 72, a backup block 74, a pierce pin holder 76, a pierce pin 78, a stripper 80 and a plurality of ejector pins 82.

Planet gear 62 is seated on a hub portion 64*a* of ramp block 64 and secured to the ramp block by pins 84. Ramp block 64 is annular and includes a central bore 64*b*. Anvil 66 is annular and includes a central bore 66*a* and a series of circumferentially spaced bores 66*b*. Ramp block 64 and anvil 66 are fitted front to back in bore 58*h* with ramp block 64 positioned against a wear bushing 86 seated at the rear of bore 58*h*. The front annular face of ramp block 64 and the confronting rear annular face of anvil 66 are provided with complementary ramp or cam surfaces seen in developed form in FIG. 5. The cam surface of ramp block 64 includes a series of flat peaks 64*c* and a series of flat valleys 64*d* interconnected by a series of upramps 64*e* and a series of downramps 64*f*. The cam surface of anvil 66 is complementary to the ramp block cam surface and includes a series of flat peaks 66*c* and a series of flat valleys 66*d* interconnected by a series of upramps 66*e* and a series of downramps 66*f*.

Die case 68 is annular and includes a central bore 68*a* and a counterbore 68*b*. Die case 68 is bolted to the front face of anvil 66 and includes a flat 68*a* for coaction with a key 84. Key 84 is seated in a cutout 58*j* in the front face of rotary block 58 and is secured to the block by bolts 88.

Shrink ring 70 is seated with a force fit in counterbore 68*b* of die case 68.

Die 72 is seated with a force fit in shrink ring 70 and seats against die case shoulder 68*c*.

Backup block 74 is cylindrical and is positioned in central bore 64*b* of ramp block 64 and seats against rotary block shoulder 58*k*. Block 74 includes a plurality of circumferentially spaced bores 74*a*.

Pierce pin holder 76 is cylindrical and is positioned in ramp block bore 64*b* in front of backup block 74. Holder 76 includes a central bore 76*a*, a counterbore 76*b*, and a plurality of circumferentially spaced bores 76*c* in registry with bores 74*a* of block 74. Holder 76 is secured to block 74 by bolts 88.

Pierce pin 78 includes a head portion 78*a* positioned in holder counterbore 76*b*, a shaft portion 78*b* extending forwardly through holder central bore 76*a* and through anvil central bore 66*a*, and a working portion 78*c* positioned centrally and immediately rearwardly of die 72.

Stripper 80 is annular and is telescopically mounted on the forward end of pierce pin 78. Ejector pins 82 extend slidably through aligned bores 74*a*, 76*c* and 66*b* for pushing engagement at their forward ends with the rear face of head portion 80*a* of stripper 80. The rearward ends of pins 82 are positioned in access openings 58*i*.

Fixed gear assembly 23 includes a central shaft 90 and a support arm 92.

Central shaft 90 includes an integral gear portion 90*a* meshing with planet gears 62 of die assemblies 60, a shaft portion 90*b* extending through central bore 58*d* of rotary block 58 and through a central bore 84*a* in key 84, a tip portion 90*c* extending forwardly from the front face of rotary block 58 and having a flat 90*d*, and a journal portion 90*e*. Tip portion 90*c* is received in a flatted hole 92*a* in the upper end of support arm 92. The lower end of arm 92 is secured to housing 20 by bolts 94 and thereby functions to fix shaft 90 against rotation. Shaft journal portion 90*e* is journaled in a bearing 96. Bearing 96 is seated in rotary block counterbore 58*f* against a shoulder 58*l* and held against axial displacement by a spacer 98 and a plug 100 threaded into rotary block threaded counterbore 58*g*.

The invention nut former is designed for use with a suitable cutter assembly such, for example, as the cutter assembly 102 of FIG. 3. Cutter assembly 102 includes a cutoff quill assembly 104 having a carbide insert 106, a cutoff knife 108 having a carbide insert 110, a pusher pin 112 slideably mounted in a pusher pin bushing 114, and a pair of transfer fingers 116.

OPERATION

In operation, suitable steel rod stock 118 is fed through quill assembly 104 and served by knife 108. The advancing knife transfers the cut blank over slug 118*a* to a position in alignment with pusher pin 112, whereafter pusher pin 112 is advanced to deliver the blank to transfer fingers 116. Fingers 116 in turn deliver the block to fixed die assembly 12 where it is dealt a first forming blow by upset punch 26 of punch assembly 10. Following this first forming blow, punch assembly 10 is retracted, ejector pin 40 is slid forwardly to eject the partially formed nut blank from die 36, and another pair of transfer fingers (not shown) receives the partially formed blank at it is ejected and delivers it to die station 16. At the same time, transfer fingers 116 are delivering another freshly cut slug to die assembly 12. U.S. Pat. No. 4,272,978 discloses a suitable mechanism for transferring partially formed blanks from die assembly 12 to die station 16 while simultaneously transferring a freshly cut slug from cutter 102 to die assembly 12. Punches 10 and 14 are now simultaneously advanced. Punch 10 delivers a first forming blow to the freshly cut slug and punch 14 delivers a second forming blow to the partially formed blank is cooperation with the die 72 then positioned at die station 16. Since the flat peak 64*c* of the confronting annular cam surfaces of ramp block 64 and anvil 66 are in firm, abutting engagement at this time, as seen in solid lines in FIG. 5, die 72 is precluded from moving rearwardly in response to the blow from punch assembly 14. As a result, pierce pin 78 plays no part at this time in the nut forming action. Following delivery of the second forming blow, punch assembly 14 is retracted and rotary block 58 is rotated through 180° to move the die 72 positioned at work station 16, together with the partially formed blank positioned therein, to the upper die station 18 while simultaneously moving the die 72 positioned at the upper work station 18 to the lower work station 16. A suitable mechanism for rotating block 58 in timed relation to the operation of the transfer fingers is disclosed in the referenced U.S. Pat. No. 4,272,978. As rotary block 58 is rotated through 180°, fixed gear assembly 23 coacts with die assemblies 60 to generate relative rotation between each ramp block 64 and its associated anvil 66 and thereby vary the angular relationship of the annular confronting cam faces on these members. More particularly, as rotary block 58 is rotated, planet gears 62, and thereby ramp blocks 64, rotate in rotary block bores 58*h*. Since anvils 66 and die casings 68 are precluded from rotating in the rotary block bores by virtue of the engagement of flats 68*a* with key 84, the rotary movement or ramp blocks 64 results in relative movement at the interface of each ramp block and the associated anvil. Specifically, as the lower die assembly is rotated from lower die station 16 to upper die station 18, ramp block 64 moves from its solid line position of FIG. 5, in which peaks 64*c* are in firm abutting engagement with peak 66*c*, to its dash line position, in which peaks 64*c* are in axial registry with valleys 66*d*. As the upper die assembly is simultaneously rotated from the upper die station 18 to the lower die station 16, ramp block 64 moved from its dash line position of FIG. 5, in which peaks 64*c* are aligned with valleys 66*d*, to its solid line position in which peaks 64*c* are in abutting engagement with peaks 66*c*. This movement may be accomplished, for example, by a system wherein central gear portion 90*a* has 12 teeth and planet gears 62 have 48 teeth, so that movement of rotary block through 180° rotates planet gears 62 through 45°, and wherein successive peaks 64*c* and successive peaks 66*c* are angularly spaced apart by 90°.

At the same time that rotary block 58 is being rotated as described to move the partially formed nut blank from lower die station 16 to upper die station 18, the transfer mechanism functions to deliver a partially formed nut blank from fixed die 12 to lower die station 16 and a freshly cut slug from the cutter to fixed die 12. Punches 10, 14 and 18 are now simultaneously advanced. Punch 10 delivers a first forming blow to the freshly cut slug positioned at die assembly 12, punch 14 delivers a second forming blow to the partially formed blank positioned at lower die station 16, and punch 18 delivers a final forming blow to the partially formed blank positioned at die station 19. However, since the coacting cam surfaces of the ramp block and anvil of the die assembly now positioned at the upper die station are spaced apart axially, die 70 moves rearwardly in response to the blow from punch 18 to force the nut blank against the forward tip of the fixed pierce pin and backpierce the blank. The nut blank thus undergoes a final forming blow and backpiercing at upper die station 19. The rearwardly displaced position of the anvil is seen in chain lines in FIG. 5. Following this final forming and piercing operation, the punches are withdrawn and rotary block 58 is rotated to move the upper die assembly to lower die station 16. As the upper die assembly moves toward the lower die station, ejector pins 82 are moved forwardly by a suitable ejector mechanism (not shown) to eject the finished nut from the die, and fixed gear 90*a* coacts with planet gear 62 to relatively rotate ramp block 64 and anvil 66. As these two parts relatively rotate, ramp 64*e* on ramp block 64 cammingly engages complementary ramp 66*e* on anvil 66 to cammingly displace the anvil forwardly with continued relative rotary movement, return the anvil and ramp block to the fully abutting, solid line position of FIG. 5. The die assembly is now positioned at lower die station 16 with die block 68 flush with the front face of rotary block 58 and die 72 blocked against rearward displacement. When punches 10, 14 and 18 are again actuated, punch 10 delivers a first forming blow to the slug in die assembly 12, punch 14 delivers a second forming blow to the nut blank at die station 16, and punch 18 delivers a final forming blow to the nut blank at die station 19 and displaces the die rearwardly to achieve backpiercing. Every advance of punches 10, 14 and 18 thus produces a fully formed, backpierced nut.

The invention nut forming apparatus produces high quality nuts and since the formed blank at die station 16 may be transferred to die station 18 without first ejecting the blank from the die, produces these high quality nuts at a higher speed than the prior art nut forming apparatus.

Whereas a preferred embodiment of the invention has been illustrated and described in detail, it will be apparent that various changes may be made in the disclosed embodiment without departing from the scope or spirit of the invention.

I claim:

1. A forming and piercing apparatus comprising:

a housing;

a rotary block mounted in said housing for rotary movement about its central longitudinal axis and defining first and second parallel cylindrical bores extending parallel to said central axis and opening at diametrically opposed locations in a top face of said block;

a set of two cylindrical members located in each bore in said rotary block; said cylindrical members having aligned longitudinal axes coaxial with said cylindrical bores and having contiguous end faces forming an interface;

identical first and second dies respectively carried on a non-contiguous end face of the cylindrical member adjacent said top face; each of said dies having a bore coaxial with said cylindrical bore; an elongated piercing pin coaxially mounted in each die bore;

coacting ramp means at the interface of each set of cylindrical members operative in one position of relative rotation of said members to preclude movement of the cylindrical member adjacent said top face in a direction away from said top face in its respective bore and operative in another position of relative rotation of said members to allow such movement;

means operative to selectively rotate said rotary block between a first position, in which said first die is at a first die station and said second die is at a second die station, and a second position, in which said first die is at said second die station and said second die is at said first die station;

a first punch mounted for coaction with a die positioned at said first die station;

a second punch mounted for coaction with a die positioned at said second die station; and means operative in response to rotation of said rotary block to move said cylindrical members into said one position of relative rotation when the associated die is moved to said first die station, whereby to allow said first punch to deliver a forming blow to a blank positioned at that die, and to move said cylindrical members into said other position of relative rotation when the associated die is moved to said second die station, whereby to allow the associated piercing pin to backpierce a blank positioned at that die upon rearward movement of that die in response to a forming blow delivered by said second punch.

2. An apparatus according to claim 1 wherein: said means for moving each set of cylindrical members between their said one and their said other positions comprises:

means operative to preclude rotation of the forward member in the respective bore;

a central gear fixedly positioned on the longitudinal center line of said rotary block; and a planet gear coaxially secured to the rearward member and meshing with said fixed central gear to rotate the rearward member in the respective bore in response to rotation of the rotary block. pg,20

3. An apparatus according to claim 2 where said apparatus further includes:

a stripper for each die telescopically mounted on an end adjacent said top face of the associated piercing pin; and at least one elongated knockout pin for each stripper extending coaxially through the associated rotary block bore with its end adjacent said top face engaging the other end of the stripper and its other end engageable by a suitable ejector mechanism.

* * * * *